208-15
C6306 OR 4,547,201

United States Patent [19]
Tewari et al.

[11] Patent Number: 4,547,201
[45] Date of Patent: Oct. 15, 1985

[54] SRC RESIDUAL FUEL OILS

[75] Inventors: Krishna C. Tewari, Whitehall; Edward P. Foster, Macungie, both of Pa.

[73] Assignee: International Coal Refining Co., Allentown, Pa.

[21] Appl. No.: 561,388

[22] Filed: Dec. 14, 1983

[51] Int. Cl.[4] ..... C10L 1/32
[52] U.S. Cl. ..... 44/51; 208/8 LE; 208/10
[58] Field of Search ..... 44/51; 208/8 LE, 10

[56] References Cited

U.S. PATENT DOCUMENTS 4,133,646 1/1979 Farcasiu et al. ..... 44/1 F
4,192,653 3/1980 Giannetti et al. ..... 44/51
4,203,823 5/1980 Carr et al. ..... 208/10
4,276,053 6/1981 Veal et al. ..... 44/61
4,376,032 3/1983 Givens ..... 208/8 LE
4,396,488 8/1983 Lebowitz et al. ..... 208/8 LE
4,411,767 10/1983 Garg ..... 208/8 LE
4,428,818 1/1984 Derbyshire et al. ..... 208/8 LE

*Primary Examiner*—William R. Dixon, Jr.
*Assistant Examiner*—Margaret B. Medley

[57] ABSTRACT

Coal solids (SRC) and distillate oils are combined to afford single-phase blends of residual oils which have utility as fuel oils substitutes. The components are combined on the basis of their respective polarities, that is, on the basis of their heteroatom content, to assure complete solubilization of SRC. The resulting composition is a fuel oil blend which retains its stability and homogeneity over the long term.

8 Claims, 6 Drawing Figures

1. NO. 6 FUEL OIL (#3)
2. TSL SRC BLEND (#2)
3. HSRC BLEND (#1)
△ 1-DAY STORED HSRC BLEND

VISCOSITY OF RESIDUAL OILS AS A FUNCTION OF TEMPERATURE

VISCOSITY CHANGE IN HSRC BLEND STORED AT 150°F

VISCOSITY CHANGE IN TSL SRC BLEND STORED AT 150°F

VISCOSITY CHANGE IN NO. 6 FUEL OIL STORED AT 150°F

1. ORIGINAL BLEND
2. STORED IN NITROGEN FOR 140 DAYS
3. STORED IN AIR FOR 140 DAYS

VISCOSITY / TEMPERATURE COMPARISON OF AGED AND UNAGED HSRC BLEND

1. ORIGINAL NO. 6 FUEL OIL
2. STORED IN NITROGEN FOR 120 DAYS
3. STORED IN AIR FOR 120 DAYS

VISCOSITY / TEMPERATURE COMPARISON OF AGED AND UNAGED NO.6 FUEL OIL

SRC RESIDUAL FUEL OILS

The Government of the United States of America has rights in this invention pursuant to Contract No. DE-AC05780RO3054 (as modified) awarded by the U.S. Department of Energy.

This invention relates to a composition of matter which has utility as a fuel oil substitute.

More specifically, this invention relates to a blend of solvent refined coal in a mixture of distillate oils. The resulting composition exhibits long term stability as a fuel oil and it may be used with only minor modification in existing infrastructures.

PRIOR ART

Coal refining consists of adding hydrogen to coal and removing its principal pollutants, sulphur and ash. First, raw coal is pulverized, mixed with a solvent derived from the refining process and heated under pressure. Hydrogen is added and the hydrogenated coal-solvent mixture is sent to a reactor vessel where liquefaction occurs. The resulting mixture is passed to a separator, naphtha and distillate liquids are drawn off, sulphur is removed as hydrogen sulphide and ash is eliminated by a conventional deashing step.

The principal product of this operation is solvent refined coal, that is, SRC which at ambient temperature is a shiny, black solid. Upon subjecting SRC to hydrogenation in a catalytic hydrocracker there is also produced TSL SRC a solid residual fuel having very low sulphur content and more naphtha and distillate liquids.

Compositions comprised of solvent refined coal and distillate oils have been reported in the literature but their use as fuel oil substitutes has not been widely accepted due to their instability over the long term. It has heretofore been believed that the asphaltenes and preasphaltenes content of the SRC would always result in an unstable mixture of SRC and coal derived liquids.

In Annual Reports by the Electric Power Research Institute (EPRI) entitled "Upgrading of Coal Liquids For Use as Power Generation Fuels," published October, 1977, December 1978, and December 1979 as Reports AF444, AF873 and AF1255 there are described blends of SRC fuel in recycled solvents. With these blends complete solubilization was not achieved due to the presence of two phases at temperatures up to 300° F. and/or benzene insoluble compounds which separated from solution over extended periods attributed to oxidation and degradation at high SRC concentrations.

In an article captioned "Viscosity of Coal Liquids—The Effect of Character and Content of the Non-Distillable Portion" (Journal of the American Chemical Society, Division of Fuel Chemistry, Volume 22: pages 33–48; 1977) J. Schiller describes a simulated fuel oil comprised of finely ground distillation residues derived from SRC and anthracene oils. These compositions exhibit a low viscosity which Schiller attributes to the synergistic effect of asphaltene on anthracene oil.

Asphaltenes are polar compounds which are found in distillation residues. They are high in heteroatom content and they possess hydroxy and nitrogen moieties which contribute to the formation of insoluble residues; however, Schiller observed, surprisingly, that the synergistic effect of asphaltene resulted in a composition free of undissolved solids. Unfortunately, however, the distillation residues in these liquids do not remain in solution indefinitely and, therefore, the synergistic effect of asphaltene cannot explain fully the undissolved solids which have been observed over extended storage periods.

THE INVENTION

Figure 1:
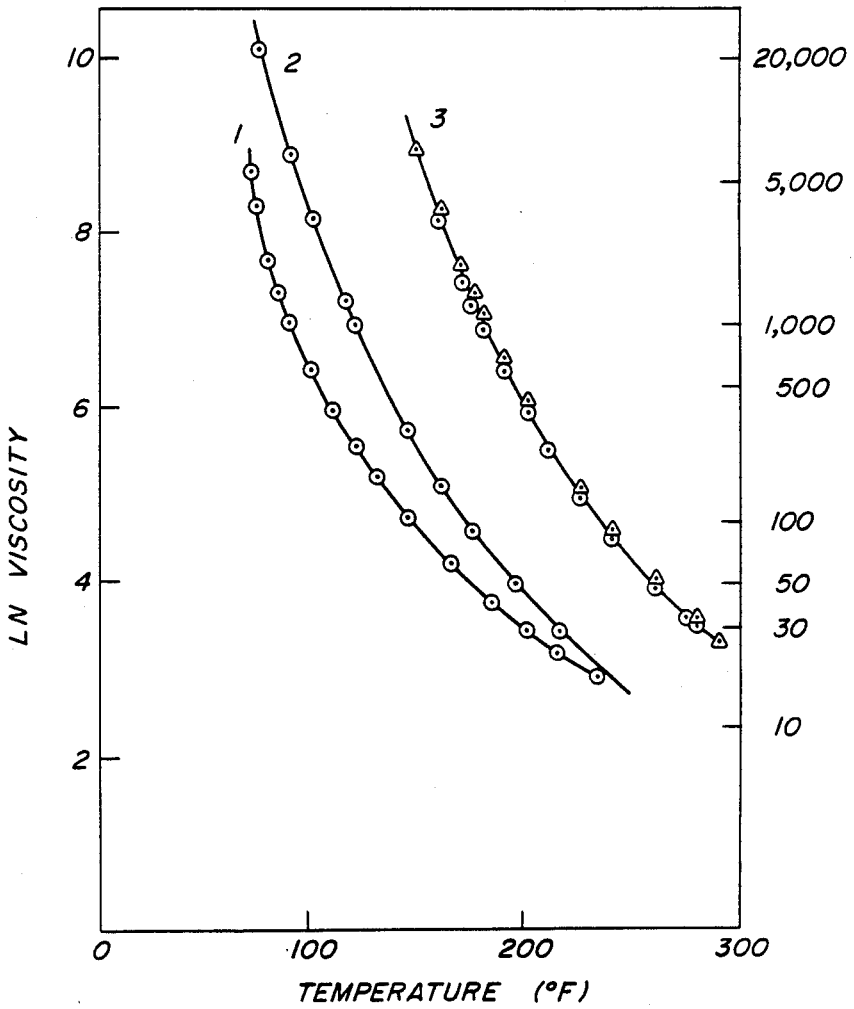
FIGS. 1–6 graphically depict the viscosity characteristics of solvent refined coal-distillate oil blends as well as the viscosity characteristics of No. 6 fuel oil in relation to temperature and storage time.

It has been discovered that deashed solvent refined coal (SRC or TSL SRC) can be combined with the distillate oils of solvent refined coal to provide compositions which are uniquely stable over long periods, a feature which makes them suitable as simulated fuel oils. The term 'SRC' is used herein to jointly and severally refer to the various sources of non-distillate solvent-refined coal products, nominally, 850° F.+ coal, for example, SRC, HSRC and TSL SRC.

Accordingly, it is an object of this invention to describe novel blends of SRC and SRC distillate oils which can be used as a No. 6 fuel oil substitute and which remain homogeneous in a single phase over extended periods.

It is a further object to describe novel means for producing single-phase homogeneous blends of SRC and SRC distillate oils by utilizing parameters which make it possible to customize the blend to specification.

A unique feature of this invention lies in the discovery that a correlation exists between the homogeneity of SRC fuel oil and the heteroatom composition of the distillate oils and the particular SRC which are mixed.

The evaluation of residual SRC oils as fuel oil substitutes led to the discovery that homogeneity and stability depend to a large extent on component characterization. SRC solids, for example, are rich in nitrogen, oxygen and sulphur, that is, heteroatoms which exert a high degree of polarity within the molecule. A contributor to this effect are the preasphaltenes which are present in solvent refined coal in appreciable amounts. The preasphaltenes are pyridine solubles rich in polar functional groups and it has been found that solubilization of SRC requires solvents having a polarity at least equal to or greater than pyridine.

This invention provides guidelines for optimizing the solubility of SRC solids in distillate oils. It identifies the polarity requirement of the solvent necessary to form homogeneous residual oil blends and specifies the compositions of heteroatom rich first-stage oil to be added to make SRC and second-stage oil homogeneous blends.

More specifically, this invention relates to a homogeneous, single-phase blend of fuel oil consisting essentially of deashed solvent-refined coal and distillate oils derived from the liquefaction of coal, said oils having a heteroatom content greater than about 25 wt% of the heteroatom content of said solvent-refined coal.

The distillate oils employed in this invention are first- and second-stage distillate oils having a boiling range of 400°–1000° F.; they are comprised nominally of 400°–650° F. middle oil, 650°–850° F. heavy oil and 450°–850° F. process solvent. These distillate oils can be used individually or they can be used in various combinations with deashed SRC to provide a homogeneous single-phase SRC residual oil blend having viscosity-temperature characteristics which make it suitable for use of substitute for No. 6 fuel oil.

The amount of distillate oil combined with deashed solvent-refined coal depends upon the heteroatom content of the distillate oil employed. At concentrations equal to or greater than 40 wt% deashed solvent refined coal cannot be mixed even at temperatures close to its flash point to form homogeneous blends with middle oil, heavy oil or process solvent of the second stage.

Generally, first stage distillate oils contain the greatest concentration of heteroatoms and, therefore, deashed solvent-refined coal (SRC) forms homogeneous blends with first-stage distillate oils at all concentrations.

On the other hand, homogeneous blends of SRC (above 40 wt%) and second-stage middle oil require the addition of first-stage heavy oil in quantities greater than 15 wt%. According to another embodiment a homogeneous blend of SRC and second-stage heavy oil can be made only if first-stage heavy oil is present in an amount at least equal to or greater than 10 wt%.

Accordng to still another embodiment homogeneous blends of SRC (above 40 wt%) and second-stage process solvent can be effected only if first-stage process solvent is present in amounts of at least 20 wt%.

Deashed SRC is a product derived from the first and/or second stage liquefaction of solvent refined coal (SRC-I) and it can be dissolved with SRC distillate oils in pulverized (solid) form or in molten form.

The following is a list of SRC solids and distillate oils referred to in this application.

SRC SOLIDS (850° F.+ BOILING RANGE)

SRC: A first-stage solvent-refined coal product (nominally greater than 850° F.) obtained after a deashing process.

HSRC: Heavy SRC; a first-stage solvent-refined coal product recovered from the SRC-I process after critical solvent deashing.

TSL SRC: A product obtained via the two-stage liquefaction of SRC (i.e., hydrocracked SRC).

Note: The term "SRC" is often used as an abbreviation for all solvent-refined coal non-distillate products such as one or all three of the above as well as the first-stage product only.

DISTILLATE OILS

Middle Oil: 400°-650° F. (first and second stage oil)
Heavy Oil: 650°-850° F. (first and second stage oil)
Process Solvent: 450°-850° F. (first & second stage oil)

The SRC solids of this invention may be dissolved in coal liquid distillates in solid form or liquid form. They are prepared by first forming an SRC mineral ash slurry and subjecting the mixture to a separation procedure, optionally followed by a hydrocracking step. This procedure is described in detail below.

MOLTEN SRC AND SRC SOLIDS (DEASHED)

SRC Mineral Ash Slurry: Dry pulverized coal slurried with process solvent was pumped to reaction pressure. The slurry was heated against hot process solvent in coal exchangers, hot hydrogen-rich recycle gas was added to the pressurized slurry and the mixture was heated to reaction temperature. There was thus obtained a slurry containing low-sulphur solvent-refined coal (SRC) and mineral ash residue with distillate liquid and gaseous by-products.

The distillate liquid by-products were separated into medium and heavy oil fractions for the recovery of process solvent and unreacted hydrogen was recovered, purified and recycled to the coal exchanger for re-use in the preparation of additional slurry.

Deashed Molten SRC: The SRC mineral ash slurry of the previous step was mixed with proprietary solvent and pumped to a first-stage settler in which a heavy phase and a light phase separated. The light phase was passed into a second stage settler where a heavy phase and light phase again separated.

The light phase from the second stage settler was passed into a third stage settler where light SRC was separated from the mixture and critical solvent was removed from the remaining heavy phase to afford deashed molten SRC.

Deashed SRC Solids: Deashed molten SRC from the prior step can be divided into three streams. One stream was sent to a hydrocracker for liquid distillate production, another was passed into a coker-calciner for coke production and the remaining stream was sent to a molten SRC tank where SRC was cooled and solidified.

The SRC solids are pulverized according to the following procedures depending upon whether a small scale (laboratory) or large scale (pilot-plant) preparation of residual oil blends is desired.

BLENDING PROCEDURES

Small Scale Blends of SRC Solids: Deashed SRC solids were pulverized 100% to 140 mesh (approximately 105 μm) and this material was added with stirring to preheated distillate oil in a three-necked round-bottomed flash (500 ml) equipped with a thermometer. The solid was added slowly over a 4 hour period at the required blending temperature (i.e., 200±5° F. for SRC and 150±5° F. for TSL SRC) to assure complete dissolution and homogeneity and stirring was continued for an additional 12 hours.

Large Scale Blends of SRC Solids: Deashed SRC solids were pulverized to −200 mesh were quckly added through a closed solids feed port to distillate oil which had been preheated to 150°-220° F. in a closed steam-heated vessel equipped with a reflux condenser. The mixing step was effected using a low shear circulating pump and a nitrogen atmosphere was maintained in the vessel to prevent contact between the blended flue and ambient air. A homogeneous blend was obtained within about 45-60 minutes following the addition of SRC solids.

Molten SRC Blends: Molten TSL SRC (200 lbs) maintained at about 600° F. was passed at a flow-rate of approximately 100 lbs per/hr into a 55 gallon closed head drum containing 200 lbs of a 1:1 mixture of first and second-stage process solvents at ambient temperature. The resulting mixture reached a maximum temperature of 350° F. and upon cooling there was obtained an SRC single-phase residual oil blend which exhibited the viscosity characteristics of a homogeneous mixture.

HETEROATOM CONTENT

The following examples illustrate the effect of heteroatom concentration on SRC solubility. All first- and second-stage solids and all distillate oils employed in these studies exhibited the following heteroatom content:

TABLE 1

| Properties of Fuel Oil Blend Components | | | | | | |
|---|---|---|---|---|---|---|
| | 1st-Stage | | | 2nd-Stage | | |
| Component: | HSRC | Middle Oil | Heavy Oil | TSL SRC | Middle Oil | Heavy Oil |
| Ultimate analysis (wt %) | | | | | | |
| C | 85.86 | 86.24 | 86.89 | 89.95 | 88.89 | 89.40 |
| H | 6.03 | 8.98 | 7.81 | 6.98 | 10.28 | 9.11 |
| N | 1.78 | 0.60 | 1.25 | 1.34 | 0.39 | 0.85 |
| O | 5.15 | 3.93 | 3.28 | 1.56 | 0.44 | 0.61 |
| S | 1.08 | 0.25 | 0.77 | 0.17 | 0.00 | 0.03 |
| Ash | 0.10 | — | — | — | — | |
| H/C, atomic ratio | 0.843 | 1.249 | 1.079 | 0.931 | 1.388 | 1.223 |

This data shows that the first stage components and lower H/C ratios and a higher heteroatom content than their second-stage counterparts. The boiling point distribution for the distillate oils of Table 1, determined by the standard ASTM D2887 simulated distillation method, is given in Tables 2–5:

TABLE 2

| Boiling Point Distribution of 1st-Stage Middle Oil by ASTM 02887 | | | |
|---|---|---|---|
| % Dist. | Temp. (°F.) | % Dist. | Temp. (°F.) |
| IBP | 391 | 60 | 540 |
| 5 | 416 | 70 | 574 |
| 10 | 424 | 80 | 607 |
| 20 | 438 | 90 | 641 |
| 30 | 462 | 95 | 664 |
| 40 | 486 | 99 | 729 |
| 50 | 516 | FBP | 783 |

TABLE 3

| Boiling Point Distribution of 1st-Stage Heavy Oil by ASTM D2887 | | | |
|---|---|---|---|
| % Dist. | Temp. (°F.) | % Dist. | Temp. (°F.) |
| IBP | 660 | 60 | 781 |
| 5 | 682 | 70 | 806 |
| 10 | 692 | 80 | 841 |
| 20 | 710 | 90 | 899 |
| 30 | 726 | 95 | 952 |
| 40 | 743 | 99 | 1010 |
| 50 | 761 | FBP | 1027 |

TABLE 4

| Boiling Point Distribution of 2nd-Stage Middle Oil by ASTM D2887 | | | |
|---|---|---|---|
| % Dist. | Temp. (°F.) | % Dist. | Temp. (°F.) |
| IBP | 375 | 60 | 587 |
| 5 | 422 | 70 | 606 |
| 10 | 450 | 80 | 626 |
| 20 | 489 | 90 | 647 |
| 30 | 520 | 95 | 658 |
| 40 | 541 | 99 | 681 |
| 50 | 562 | FBP | 708 |

TABLE 5

| Boiling Point Distribution of 2nd-Stage Heavy Oil by ASTM D2887 | | | |
|---|---|---|---|
| % Dist | Temp. (°F.) | % Dist. | Temp. (°F.) |
| IBP | 640 | 60 | 759 |
| 5 | 663 | 70 | 783 |
| 10 | 674 | 80 | 813 |
| 20 | 691 | 90 | 862 |
| 30 | 705 | 95 | 906 |

TABLE 5-continued

| Boiling Point Distribution of 2nd-Stage Heavy Oil by ASTM D2887 | | | |
|---|---|---|---|
| % Dist | Temp. (°F.) | % Dist. | Temp. (°F.) |
| 40 | 722 | 99 | 1010 |
| 50 | 739 | FBP | 1035 |

The foregoing shows that the second stage middle oil and first stage heavy oil contain a preponderance of heavy components and, as a result, they are more viscous than their respective first-stage middle oil and second-stage heavy oil counter parts.

Tables 6 and 7 show the relationship between temperature and viscosity for the first and second stage middle and heavy oils. The liquids exhibited Newtonian behavior over all temperature ranges:

TABLE 6

| Variation of Viscosity with Temperature, 1st-Stage Middle and Heavy Oils | | | |
|---|---|---|---|
| Oil | Temperature (°F.) | Shear Rate ($sec^{-1}$) | Viscosity (cP) |
| Middle | 70 | 79.20 | 9.6 |
| | | 39.60 | 9.6 |
| | 80 | 79.20 | 7.2 |
| | | 39.60 | 7.0 |
| | 90 | 79.20 | 4.8 |
| | | 39.60 | 4.7 |
| Heavy | 100 | 2.04 | 8288 |
| | | 1.02 | 8292 |
| | | 0.51 | 8300 |
| | 110 | 4.08 | 3019 |
| | | 2.04 | 3021 |
| | | 1.02 | 3025 |
| | 120 | 10.20 | 1343 |
| | | 4.08 | 1350 |
| | | 2.04 | 1350 |
| | 125 | 20.40 | 925 |
| | | 10.20 | 935 |
| | | 4.08 | 938 |
| | 135 | 20.40 | 500 |
| | | 10.20 | 500 |
| | | 4.08 | 500 |
| | 145 | 15.84 | 274 |
| | | 7.92 | 273 |
| | | 3.96 | 275 |
| | 155 | 39.60 | 163 |
| | | 15.84 | 164 |
| | | 7.92 | 164 |
| | 165 | 79.20 | 103 |
| | | 30.60 | 104 |
| | | 15.84 | 104 |
| | 180 | 79.20 | 57.9 |
| | | 39.60 | 58.0 |
| | | 15.84 | 57.9 |
| | 200 | 79.20 | 30.4 |
| | | 39.60 | 30.5 |

TABLE 7

| Variation of Viscosity with Temperature, 2nd-Stage Middle and Heavy Oils | | | |
|---|---|---|---|
| Oil | Temperature (°F.) | Shear Rate ($sec^{-1}$) | Viscosity (cP) |
| Middle | 70 | 79.20 | 10.6 |
| | | 39.60 | 10.7 |
| | 80 | 79.20 | 7.7 |
| | | 39.60 | 7.6 |
| | 90 | 79.20 | 5.9 |
| | | 39.60 | 5.9 |
| Heavy | 74 | 1.98 | 2915 |
| | | 0.79 | 2917 |
| | 80 | 3.96 | 1715 |
| | | 1.98 | 1730 |
| | | 0.79 | 1738 |
| | 85 | 7.92 | 1178 |
| | | 3.96 | 1180 |

TABLE 7-continued

| Variation of Viscosity with Temperature, 2nd-Stage Middle and Heavy Oils | | | |
|---|---|---|---|
| Oil | Temperature (°F.) | Shear Rate ($sec^{-1}$) | Viscosity (cP) |
| | | 1.98 | 1185 |
| | 90 | 7.92 | 829 |
| | | 3.96 | 833 |
| | | 1.98 | 835 |
| | 95 | 15.84 | 584 |
| | | 7.92 | 591 |
| | | 3.96 | 593 |
| | 100 | 15.84 | 441 |
| | | 7.92 | 444 |
| | | 3.96 | 443 |
| | 110 | 15.84 | 256 |
| | | 7.92 | 258 |
| | | 3.96 | 260 |
| | 120 | 39.60 | 152 |
| | | 15.84 | 154 |
| | | 7.92 | 155 |
| | 140 | 79.20 | 66.8 |
| | | 39.60 | 66.8 |
| | | 15.84 | 66.9 |
| | 165 | 79.20 | 29.9 |
| | | 39.60 | 30.0 |
| | | 15.84 | 30.0 |

The data of Tables 6 and 7 show that the viscosity of the liquid is related to its structural composition and heteroatom content.

This invention will now be illustrated by reference to specific embodiments.

EXAMPLE 1

Single-Phase Solid/Liquid Blends

HSRC and TSL SRC solids were pulverized to a fineness of 100% through 140 mesh, approximately 105 μm. Single-phase blends were prepared in a three-necked, round-bottomed flask (500 ml) equipped with a thermometer and a glass stirrer. Fifty percent by weight of pulverized solids were added to preheated distillate liquids with constant stirring as described below. To assure complete dissolution and homogeneous mixing, the solids were added slowly over a 4 hr period at the required blending temperature (i.e., 200±5° F. for HSRC and TSL SRC, respectively) maintained for at least 12 hours.

The following blends of 50 wt% solid composition were prepared:

HSRC/1st-stage middle oil
HSRC/1st stage heavy oil
TSL SRC/1st-stage middle oil
TSL SRC/2nd stage middle oil
TSL SRC/1st-stage heavy oil
TSL SRC/2nd-stage heavy oil The viscosities of the blends at specific temperatures and shear rates, as determined by a Brookfield viscometer, are listed in Tables 8–13. The range of applied shear rates varied with the viscosity of the blend and the spindle used. The blends behaved like a Newtonian liquid within experimental error. All blends were solid at ambient temperature and showed no separation of a liquid phase.

TABLE 8

| Variation of Viscosity with Temperature, 50 wt % HSRC in 1st-Stage Middle Oil | | |
|---|---|---|
| Temperature (°F.) | Shear Rate ($sec^{-1}$) | Viscosity (cP) |
| 100 | 0.20 | 68,500 |

TABLE 8-continued

| Variation of Viscosity with Temperature, 50 wt % HSRC in 1st-Stage Middle Oil | | |
|---|---|---|
| Temperature (°F.) | Shear Rate ($sec^{-1}$) | Viscosity (cP) |
| | 0.10 | 69,000 |
| 115 | 1.02 | 16,600 |
| | 0.51 | 16,800 |
| | 0.20 | 17,000 |
| 130 | 4.08 | 5,125 |
| | 2.04 | 5,175 |
| | 1.02 | 5,200 |
| 145 | 10.20 | 1,938 |
| | 4.08 | 1,956 |
| | 2.04 | 1,963 |
| 160 | 20.40 | 859 |
| | 10.20 | 868 |
| | 4.08 | 869 |
| 175 | 15.84 | 382 |
| | 7.92 | 385 |
| | 3.96 | 388 |
| 190 | 39.60 | 200 |
| | 15.84 | 201 |
| | 7.92 | 204 |
| 215 | 79.20 | 82.1 |
| | 39.60 | 83.0 |
| | 15.84 | 83.1 |
| 240 | 79.20 | 41.5 |
| | 39.60 | 41.3 |
| | 15.84 | 41.9 |
| 265 | 79.20 | 22.6 |
| | 39.60 | 23.0 |

TABLE 9

| Variation of Viscosity with Temperature, 50 wt % HSRC in 1st-Stage Heavy Oil | | |
|---|---|---|
| Temperature (°F.) | Shear Rate ($sec^{-1}$) | Viscosity (cP) |
| 220 | 0.84 | 31,350 |
| | 0.42 | 31,533 |
| | 0.17 | 31,750 |
| 230 | 1.68 | 14,950 |
| | 0.84 | 14,950 |
| | 0.42 | 15,000 |
| 240 | 3.36 | 7,450 |
| | 1.68 | 7,467 |
| | 0.84 | 7,467 |
| 250 | 1.98 | 3,700 |
| | 0.79 | 3,725 |
| | 0.40 | 3,750 |
| 270 | 7.92 | 1,201 |
| | 3.96 | 1,213 |
| | 1.98 | 1,220 |
| 290 | 15.84 | 463 |
| | 7.92 | 464 |
| | 3.96 | 468 |
| 310 | 39.60 | 209 |
| | 15.84 | 211 |
| | 7.92 | 214 |
| 335 | 79.20 | 95.0 |
| | 39.60 | 95.0 |
| | 15.84 | 96.3 |
| 360 | 79.20 | 48.4 |
| | 39.60 | 48.3 |
| 385 | 79.20 | 27.9 |
| | 39.60 | 28.3 |
| 415 | 79.20 | 16.1 |
| | 39.60 | 16.0 |

TABLE 10

| Variation of Viscosity with Temperature, 50 wt % TSL SRC in 1st-Stage Middle Oil | | |
|---|---|---|
| Temperature (°F.) | Shear Rate ($sec^{-1}$) | Viscosity (cP) |
| 75 | 2.04 | 6,738 |
| | 1.02 | 6,775 |
| | 0.51 | 6,900 |

TABLE 10-continued

| Variation of Viscosity with Temperature, 50 wt % TSL SRC in 1st-Stage Middle Oil | | |
|---|---|---|
| Temperature (°F.) | Shear Rate ($sec^{-1}$) | Viscosity (cP) |
| 85 | 4.08 | 3,300 |
| | 2.04 | 3,325 |
| | 1.02 | 3,350 |
| 95 | 10.20 | 1,683 |
| | 4.08 | 1,700 |
| | 2.04 | 1,725 |
| 105 | 20.40 | 931 |
| | 10.20 | 943 |
| | 4.08 | 956 |
| 120 | 15.84 | 423 |
| | 7.92 | 428 |
| | 3.96 | 433 |
| 135 | 39.60 | 212 |
| | 15.84 | 215 |
| | 7.92 | 219 |
| 155 | 79.20 | 99.1 |
| | 39.60 | 100 |
| | 15.84 | 102 |
| 180 | 79.20 | 47.6 |
| | 39.60 | 47.5 |
| | 15.84 | 48.8 |
| 200 | 79.20 | 28.8 |
| | 39.60 | 29.3 |
| | 15.84 | 30.6 |
| 225 | 79.20 | 17.4 |
| | 39.60 | 18.0 |

TABLE 11

| Variation of Viscosity with Temperature, 50 wt % TSL SRC in 2nd-Stage Middle Oil | | |
|---|---|---|
| Temperature (°F.) | Shear Rate ($sec^{-1}$) | Viscosity (cP) |
| 75 | 2.04 | 11,188 |
| | 1.02 | 11,300 |
| | 0.51 | 11,350 |
| 85 | 4.08 | 5,231 |
| | 2.04 | 5,300 |
| | 1.02 | 5,300 |
| 95 | 4.08 | 2,694 |
| | 2.04 | 2,700 |
| | 1.02 | 2,700 |
| 105 | 10.20 | 1,465 |
| | 4.08 | 1,469 |
| | 2.04 | 1,471 |
| 120 | 15.84 | 607 |
| | 7.92 | 615 |
| | 3.96 | 618 |
| 135 | 15.84 | 305 |
| | 7.92 | 306 |
| | 3.96 | 308 |
| 155 | 39.60 | 137 |
| | 15.84 | 137 |
| | 7.92 | 138 |
| 180 | 79.20 | 60.3 |
| | 39.60 | 60.8 |
| | 15.84 | 61.3 |
| 200 | 79.20 | 35.8 |
| | 39.60 | 35.8 |
| 225 | 79.20 | 20.6 |
| | 39.60 | 20.8 |

TABLE 12

| Variation of Viscosity with Temperature, 50 wt % TSL SRC in 1st-Stage Heavy Oil | | |
|---|---|---|
| Temperature (°F.) | Shear Rate ($sec^{-1}$) | Viscosity (cP) |
| 170 | 0.20 | 58,125 |
| | 0.10 | 58,500 |
| 185 | 1.02 | 15,825 |
| | 0.51 | 15,850 |
| | 0.20 | 15,875 |
| 200 | 4.08 | 5,200 |

TABLE 12-continued

| Variation of Viscosity with Temperature, 50 wt % TSL SRC in 1st-Stage Heavy Oil | | |
|---|---|---|
| Temperature (°F.) | Shear Rate ($sec^{-1}$) | Viscosity (cP) |
| | 2.04 | 5,225 |
| | 1.02 | 5,225 |
| 215 | 10.20 | 1,980 |
| | 4.08 | 1,981 |
| | 2.04 | 1,988 |
| 230 | 20.40 | 861 |
| | 10.20 | 861 |
| | 4.08 | 863 |
| 245 | 15.84 | 408 |
| | 7.92 | 409 |
| | 3.96 | 410 |
| 260 | 39.60 | 221 |
| | 15.84 | 221 |
| | 7.92 | 221 |
| 275 | 39.60 | 129 |
| | 15.84 | 129 |
| | 7.92 | 129 |
| 295 | 79.20 | 69.0 |
| | 39.60 | 69.4 |
| 315 | 79.20 | 40.6 |
| | 39.60 | 40.6 |
| 340 | 79.20 | 23.4 |
| | 39.60 | 23.3 |
| 365 | 79.20 | 14.6 |
| | 39.60 | 14.5 |

TABLE 13

| Variation of Viscosity with Temperature, 50 wt % TSL SRC in 2nd-Stage Heavy Oil | | |
|---|---|---|
| Temperature (°F.) | Shear Rate ($sec^{-1}$) | Viscosity (cP) |
| 150 | 0.20 | 56,750 |
| | 0.10 | 56,750 |
| 170 | 2.04 | 11,100 |
| | 1.02 | 11,125 |
| | 0.51 | 11,150 |
| 190 | 4.08 | 2,994 |
| | 2.04 | 3,000 |
| | 1.02 | 3,000 |
| 210 | 20.40 | 973 |
| | 10.20 | 978 |
| | 4.08 | 975 |
| 220 | 20.40 | 601 |
| | 10.20 | 603 |
| | 4.08 | 606 |
| 240 | 39.60 | 247 |
| | 15.84 | 248 |
| | 7.92 | 250 |
| 265 | 79.20 | 106 |
| | 39.60 | 106 |
| | 15.84 | 105 |
| 290 | 79.20 | 52.5 |
| | 39.60 | 52.5 |
| 310 | 79.20 | 32.4 |
| | 39.60 | 32.3 |
| 330 | 79.20 | 17.9 |
| | 39.60 | 17.9 |

The foregoing shows that HSRC forms homogeneous blends with first stage distillate oils at all concentration levels. This is attributable to the presence in HSRC of high concentrations of preasphaltenes, that is, pyridine solubles rich in highly polar functional groups. Accordingly, the complete solubilization of HSRC requires a solvent having a polarity equal to or greater than pyridine. First-stage distillate oils possess an essentially identical profile, that is, they are relatively high in heteroatom content and possess high polarity as a result of which they solubilize the highly polar HSRC.

On the other hand, second-stage distillate oils are not sufficiently rich in heteroatom content and their low polarity make it impossible to solubilize HSRC. This conclusion is supported by the observations reported in Example 2 and the accompanying Tables 14 and 15.

By contrast, TSL SRC has a negligible concentration of preasphaltenes. Accordingly, it is compatible with the low heteroatom content of the second-stage oil and is solubilized thereby. See in this regard the reduced heteroatom content (polarity) of the second-stage distillate oil as compared to the first stage oil in Table 1.

Indeed, TSL SRC forms homogeneous blends with first-and second-stage distillate oils or mixtures of same at all concentration levels.

Example 2 illustrates the limited solubility of HSRC in second-stage oils even when additions are made close to the flash point temperatures. The inability of the second-stage oils to completely solubilize HSRC is attributed to the low heteroatom content (i.e., low polarity) of the second-stage oil.

EXAMPLE 2

Dual-Phase HSRC Blends

The procedure of Example 1 was repeated except that 50 wt% of pulverized HSRC was added to second-stage middle oil and second-stage heavy oil.

A partial separation of the oil phase in both preparations was observed at ambient temperature.

The variation in viscosity and shear rates over a range of temperatures are listed in Tables 14 and 15.

TABLE 14

Variation of Viscosity with Temperature, 50 wt % HSRC in 2nd-Stage Middle Oil

| Temperature (°F.) | Shear Rate ($sec^{-1}$) | Viscosity (cP) |
|---|---|---|
| 115 | 0.79 | 8,125 |
| | 0.40 | 12,100 |
| 130 | 1.98 | 2,170 |
| | 0.79 | 3,925 |
| | 0.40 | 6,242 |
| 145 | 7.92 | 788 |
| | 3.96 | 1,043 |
| | 1.98 | 1,257 |
| 160 | 15.84 | 372 |
| | 7.92 | 496 |
| | 3.96 | 719 |
| 175 | 39.60 | 228 |
| | 15.84 | 281 |
| | 7.92 | 405 |
| 250 | 79.20 | 67 |
| | 39.60 | 102 |
| | 15.84 | 216 |

TABLE 15

Variation of Viscosity with Temperature, 50 wt % HSRC in 2nd-Stage Heavy Oil

| Temperature (°F.) | Shear Rate ($sec^{-1}$) | Viscosity (cP) |
|---|---|---|
| 240 | 0.20 | 9,738 |
| | 0.10 | 16,150 |
| 265 | 20.40 | 686 |
| | 10.20 | 1,217 |
| | 4.08 | 2,569 |
| 290 | 20.40 | 529 |
| | 10.20 | 1,018 |
| | 4.08 | 1,738 |
| 315 | 20.4 | 341 |
| | 10.20 | 425 |

The observed decrease in viscosity with shear rates is indicative of a multi-phase composition rather than a homogeneous blend of components.

Moreover, the observed viscosities in second-stage middle oil (Table 14) and the viscosities observed in second-stage heavy oil (Table 15) indicate that at the specified temperatures the viscosity of each mixture depended on the applied shear rate. The non-Newtonian behavior of these mixtures suggests that the blends do not exist as single phase compositions due to the limited solubility of HSRC in second-stage oils. Partial separation of the oil phase was also observed when mixtures were allowed to cool to ambient temperature, further substantiating the non-homogeneous nature of these mixtures.

A major portion of HSRC consists of pyridine-soluble preasphaltenes, that is, compounds rich in polar functional groups. Accordingly, the complete solubilization of HSRC requires the use of solvents having a polarity equal to or greater than that of pyridine. Unfortunately, the low heteroatom second-stage oils do not possess this property.

EXAMPLE 3

Single-Phase HSRC Blends

The procedure of Example 1 was repeated except that HSRC was combined with mixtures of first-stage heavy oil and second-stage heavy oil.

Table 16 lists the viscosities observed for a blend of 40 wt% HSRC solids with 10 wt% first-stage heavy oil and 50 wt% second-stage heavy oil over a range of temperatures and shear rates:

TABLE 16

Variation of Viscosity with Temperature, (HSRC - 40 wt %, Heavy Oil 1st-Stage - 10 wt %, Heavy Oil 2nd-Stage - 50 wt %)

| Temperature (°F.) | Shear Rate ($sec^{-1}$) | Viscosity (cP) |
|---|---|---|
| 180 | 0.20 | 54,750 |
| | 0.10 | 54,750 |
| 200 | 2.04 | 7,350 |
| | 1.02 | 7,350 |
| | 0.51 | 7,400 |
| 220 | 10.20 | 1,755 |
| | 4.08 | 1,763 |
| | 2.04 | 1,775 |
| 230 | 20.40 | 1,055 |
| | 10.20 | 1,066 |
| | 4.08 | 1,069 |
| 240 | 20.40 | 628 |
| | 10.20 | 628 |
| | 4.08 | 631 |
| 260 | 39.60 | 238 |
| | 15.84 | 239 |
| | 7.92 | 240 |
| 280 | 79.20 | 110 |
| | 39.60 | 110 |
| | 15.84 | 113 |
| 305 | 79.20 | 50.9 |
| | 39.60 | 51.0 |
| 330 | 79.20 | 27.4 |
| | 39.60 | 28.0 |

Table 17 lists the viscosities observed for a blend of 50 wt% HSRC solids with 10 wt% first-stage heavy oil and 40 wt% second-stage heavy oil over a range of temperatures and shear rates:

TABLE 17

Variation of Viscosity with Temperature, (HSRC - 50 wt %, Heavy Oil 1st-Stage - 10 wt %, Heavy Oil 2nd-Stage - 40 wt %)

| Temperature (°F.) | Shear Rate ($sec^{-1}$1) | Viscosity (cP) |
|---|---|---|
| 220 | 0.20 | 52,500 |

TABLE 17-continued

| Variation of Viscosity with Temperature, (HSRC - 50 wt %, Heavy Oil 1st-Stage - 10 wt %, Heavy Oil 2nd-Stage - 40 wt %) | | |
|---|---|---|
| Temperature (°F.) | Shear Rate ($sec^{-1}$) | Viscosity (cP) |
| | 0.10 | 53,250 |
| 240 | 2.04 | 9,188 |
| | 1.02 | 9,175 |
| | 0.51 | 9,200 |
| 255 | 4.08 | 3,100 |
| | 2.04 | 3,125 |
| | 1.02 | 3,125 |
| 265 | 10.20 | 1,685 |
| | 4.08 | 1,688 |
| | 2.04 | 1,688 |
| 275 | 20.40 | 980 |
| | 10.20 | 983 |
| | 4.08 | 988 |
| 295 | 20.40 | 379 |
| | 10.20 | 380 |
| 315 | 39.60 | 165 |
| | 15.84 | 167 |
| | 7.92 | 168 |
| 335 | 79.20 | 87.5 |
| | 39.60 | 87.5 |
| 360 | 79.20 | 45.1 |
| | 39.60 | 45.2 |
| 390 | 79.20 | 23.4 |
| | 39.60 | 23.4 |

Both HSRC mixtures provided single-phase homogeneous blends. These observations and the supporting data support the view that a homogeneous blend of HSRC and second-stage heavy oil can be made if first-stage heavy oil is added in amounts at least equal to or greater than 10 wt%.

The addition of first-stage oil is necessary to solubilize the HSRC solids because the low-heteroatom content of the second-stage oils is not sufficient to solubilize HSRC. By contrast, the first-stage oils are rich in heteroatom content and their addition to second-stage oil results in an increase in polarity to the extent that it solubilizes HSRC.

EXAMPLE 4

HSRC-Middle Oil Blends

By following the procedure of Example 1 using HSRC, second-stage middle oil and first-stage heavy oil in various combinations, it was determined that homogeneous blends of HSRC and second-stage middle oil require the addition of first-stage heavy oil in amounts greater than 15 wt%.

Table 18 lists the viscosities for a blend of HSRC with second-stage middle oil and first-stage heavy oil over a range of temperatures and shear rates:

TABLE 18

| Variation of Viscosity with Temperature, (HSRC - 40 wt %, Heavy Oil 1st-Stage - 15 wt %, Middle Oil 2nd-Stage - 45 wt %) | | |
|---|---|---|
| Temperature (°F.) | Shear Rate ($sec^{-1}$) | Viscosity (cP) |
| 120 | 10.20 | 2,155 |
| | 4.08 | 2,775 |
| | 2.04 | 3,738 |
| 150 | 20.40 | 843 |
| | 10.20 | 898 |
| | 4.08 | 1,181 |
| 180 | 20.40 | 329 |
| | 10.20 | 345 |

Due to the small heteroatom content of second-stage middle oil relatively high concentrations of first-stage heavy oil (rich in heteroatom content) are needed to prepare single-phase HSRC blends. The data in Table 18 indicates that first-stage oil concentrations in excess of 15 wt% should be added to HSRC and second-stage middle oil in order to prepare a 40 wt% HSRC single-phase blend in second-stage middle oil.

The blend in Table 18 developed a partial separation of a oil phase at ambient temperature. Moreover, the decrease in viscosity and concomitant increase in shear rate is indicative of multi-phase mixture rather than a homogeneous blend.

EXAMPLE 5

HSRC/Process Solvent Blends

Blends containing more than 40 wt% of HSRC and second-stage process solvent require the addition of first-stage process solvent in amounts at least equal to 20 wt% in order to afford homogeneous fuel oil blends.

Table 19 summarizes the viscosity/temperature data for the single-phase blend of 50 wt% HSRC in a 2:3 mixture of first-and second-stage process solvents.

TABLE 19

| Variation of Viscosity with Temperature, HSRC: 50 wt %, Process Solvent 1st-Stage: 20 wt %, Process Solvent 2nd-Stage: 30 wt % | | |
|---|---|---|
| Temperature (°F.) | Shear Rate ($sec^{-1}$) | Viscosity (cP) |
| 169 | 4.08 | 5056 |
| | 2.04 | 5113 |
| | 1.02 | 5125 |
| 179 | 4.08 | 2500 |
| | 2.04 | 2525 |
| | 1.02 | 2550 |
| 189 | 10.20 | 1345 |
| | 4.08 | 1356 |
| | 2.04 | 1363 |
| 194 | 20.40 | 1005 |
| | 10.20 | 1015 |
| | 4.08 | 1019 |
| 204 | 20.40 | 616 |
| | 10.20 | 620 |
| 219 | 15.84 | 294 |
| | 7.92 | 294 |
| | 3.96 | 300 |
| 240 | 39.60 | 133 |
| | 15.84 | 132 |
| | 7.92 | 133 |
| 260 | 79.20 | 69.0 |
| | 39.60 | 69.0 |
| | 15.84 | 69.4 |
| 286 | 79.20 | 35.4 |
| | 39.60 | 35.3 |
| 291 | 79.20 | 33.8 |
| | 39.60 | 33.8 |
| 311 | 79.20 | 23.8 |
| | 39.60 | 23.8 |

The foregoing data supports the view that the rich heteroatom content of the first-stage process solvent is required in amounts of at least 20 wt% in order to fully solubilize the HSRC solids.

EXAMPLE 6

Storage Stability Test

The following residual fuel oils were subjected to storage stability testing:

| | Fuel composition (wt %) | | |
|---|---|---|---|
| Component | #1 | #2 | #3 |
| HSRC | 50 | — | — |

-continued

| Component | Fuel composition (wt %) #1 | #2 | #3 |
|---|---|---|---|
| 1st-stage middle oil | 40 | 30 | — |
| 1st-stage heavy oil | 10 | 5 | — |
| TSL SRC | — | 50 | — |
| 2nd-stage middle oil | — | 12 | — |
| 2nd-stage heavy oil | — | 3 | — |
| No. 6 Fuel Oil | — | — | 100 |

The above HSRC and TSL SRC blend compositions simulate, respectively, the first-stage and second-stage SRC-I Demonstration Plant total blended products (excluding naphtha and anode coke). Table 20 shows that the H/C ratio and heating values increase in the following order: HSRC blend <TSL SRC blend <No. 6 Fuel Oil.

TABLE 20

Properties of Residual Fuel Oils Used for Stability Tests

| Residual Oil | HSRC Blend #1 | TSL SRC Blend #2 | No. 6 Fuel Oil #3 |
|---|---|---|---|
| Ultimate Analysis, wt % | | | |
| C | 85.60 | 88.40 | 86.34 |
| H | 7.23 | 8.13 | 11.48 |
| N | 1.24 | 1.01 | 0.27 |
| O | 4.81 | 2.23 | 0.87 |
| S | 1.04 | 0.23 | 0.99 |
| Ash | 0.08 | — | 0.05 |
| H/C (atomic ratio) | 1.014 | 1.104 | 1.596 |
| Higher Heating Value, Btu/lb | 16.849 | 17.343 | 18.749 |

After 1 day there was sufficient evaporation of volatile components within the vapor space of the storage bottle as to require a 3° F. higher temperature to maintain the original viscosity. As shown in FIG. 1 the temperature required for the residual oils to reach viscosities of 30 cP (atomizing) and 1,000 cp (pumping) are as follows:

| Residual Oil | Temperature (°F.) at: 30 cP | 1,000 cP |
|---|---|---|
| HSRC blend (#1) | 282 | 180 |
| TSL SRC blend (#2) | 217 | 121 |
| No. 6 Fuel Oil (#3) | 203 | 92 |

Figure 2:
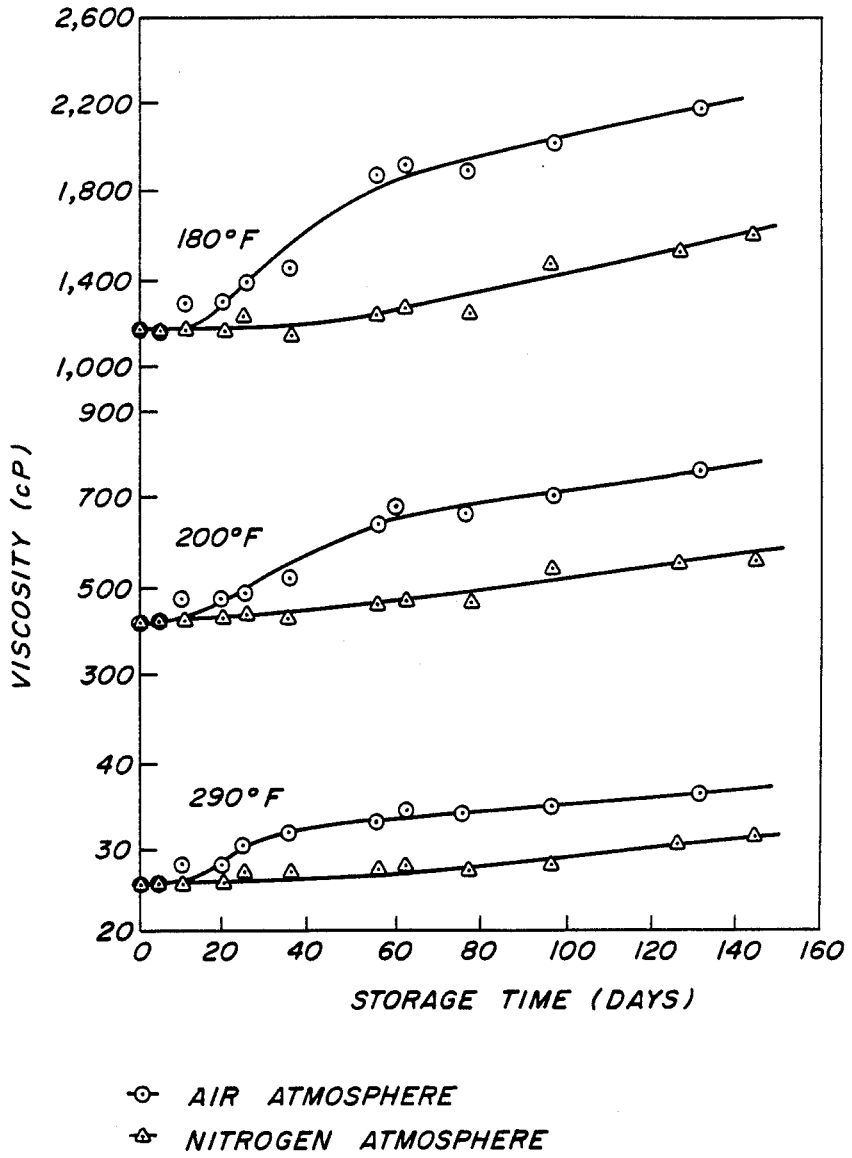
Figure 3:
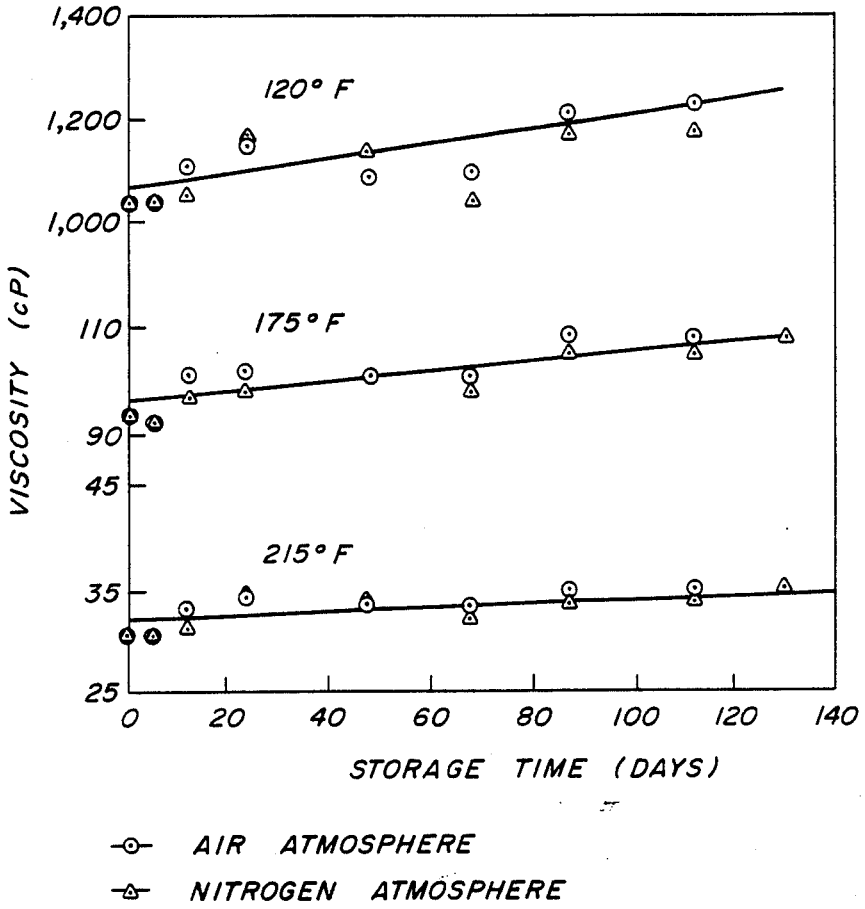
Figure 4:
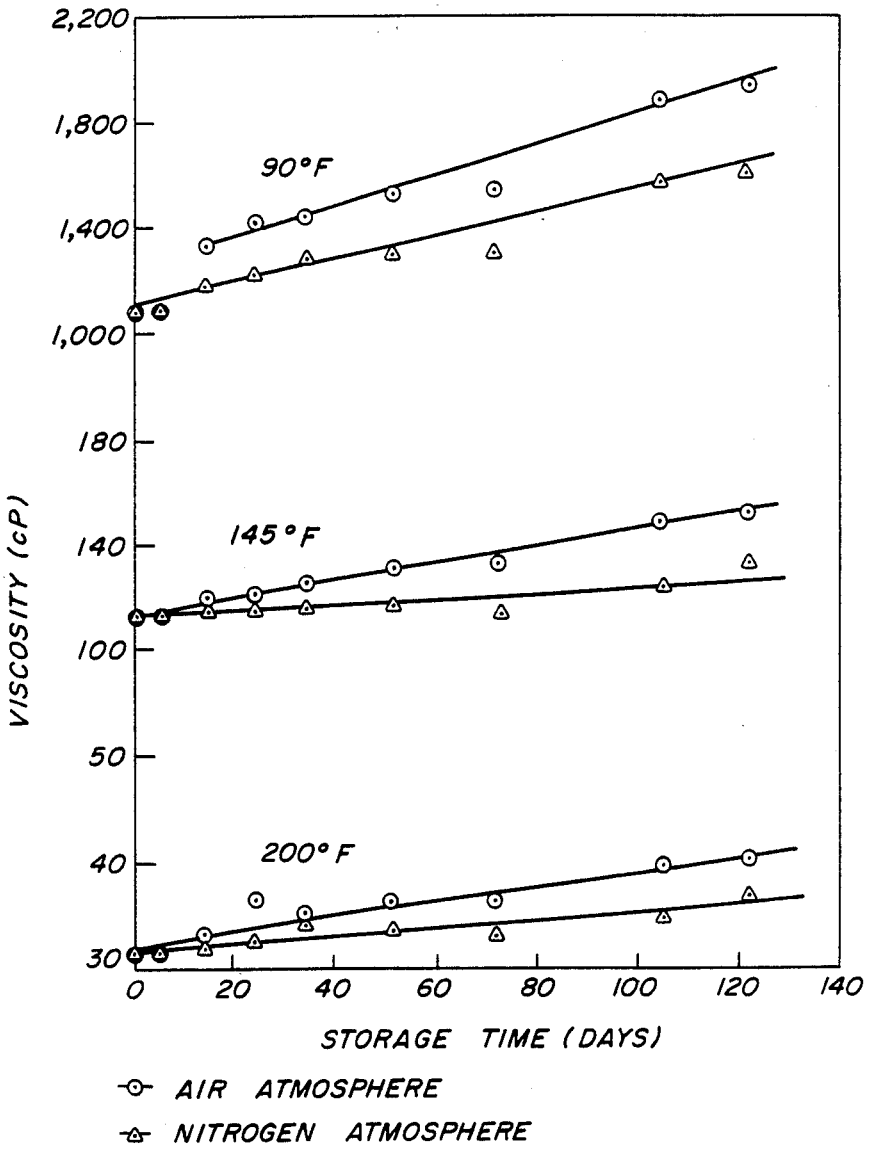

The residual oils were then subjected to a 4–5 month storage stability test at 150° F. in controlled nitrogen and air atmospheres. Various 1 oz. vials, each containing approximately 10 ml of the residual oil, were capped after flushing with the desired gas and then stored in a 150° F. isothermal oven. The temperature and atmosphere of the oven were maintained by the slow circulation of the gas. At specified intervals, one vial of each residual oil was taken from the oven to measure viscosities at three temperatures used to monitor fuel aging with time. FIGS. 2–4 depict the resulting changes in viscosity. Although the residual oils were stored in closed vials of the same size, some loss of volatiles undoubtedly occured during high-temperature storage, and such losses contribute to an increase in the viscosity. However, since storage conditions, temperatures, and viscosity measurement procedures were the same, the loss of material and its impact upon viscosity should be considered constant for the same residual oil stored under air or nitrogen. Therefore, it is apparent that storage in air had some adverse effect on the stability of No. 6 Fuel Oil and HSRC residual oil, but virtually no effect on TSL SRC residual oil.

Figure 5:
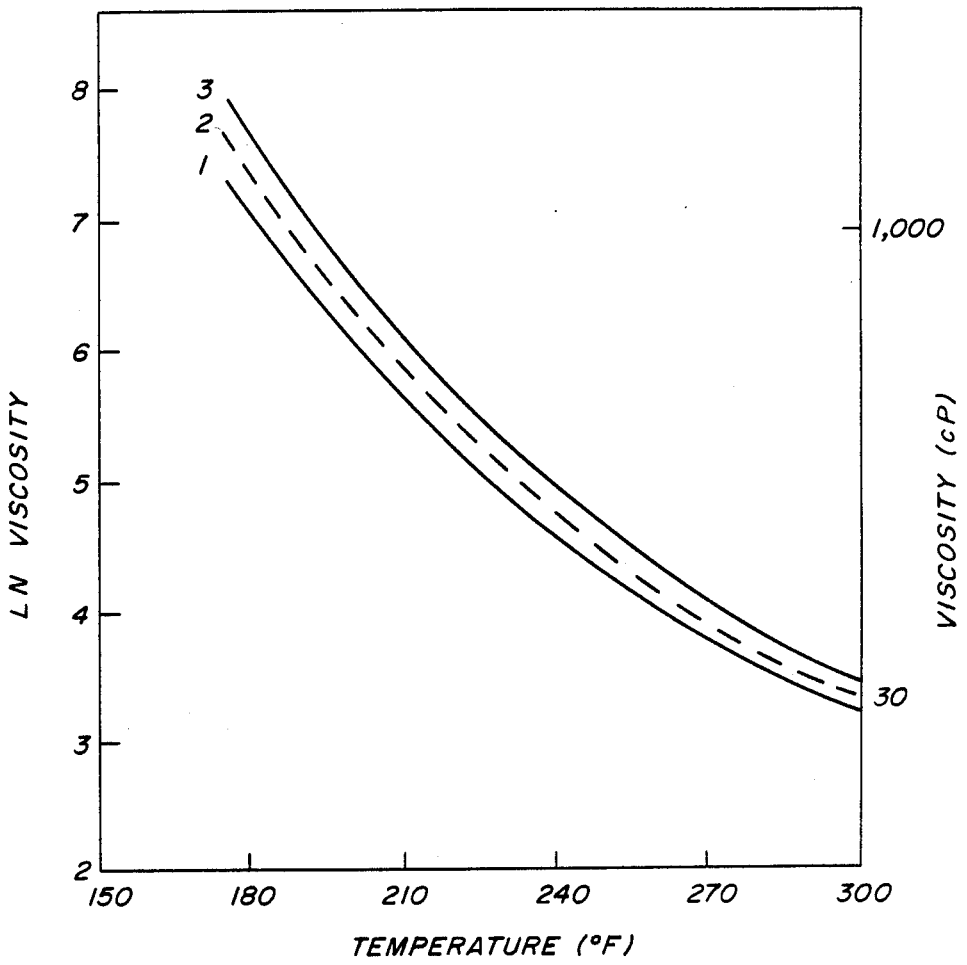
Figure 6:
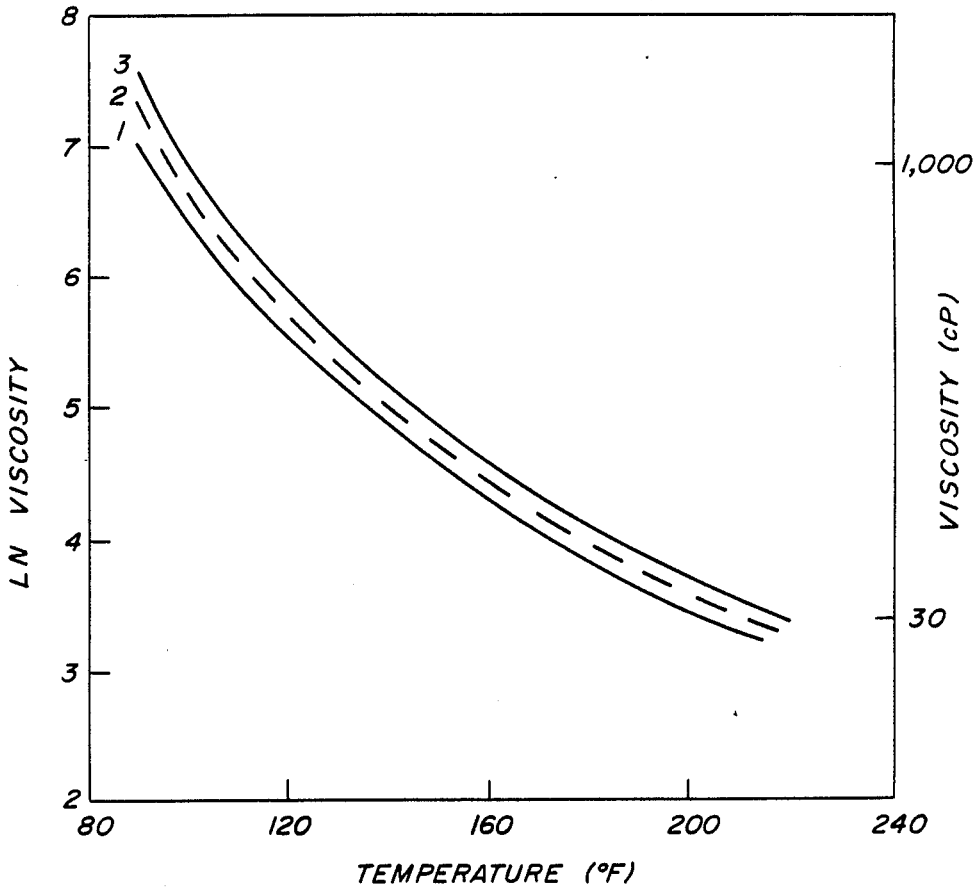

The air-stored HSRC residual oil, the most rapid increase in viscosity occurred during the 20–60 day storage period; after 60 days, viscosity increased less rapidly. FIG. 5 shows that the temperature increases required to bring 140-day air- and nitrogen-aged HSRC residual-oil samples to the original pumping viscosity of 1,000 cP were 10° and 6° F., respectively. FIG. 6 shows that the temperature increases required to bring the 120-day air- and nitrogen-aged No. 6 Fuel Oil samples to the original pumping viscosity of 1,000 cP were 8° and 4° F., respectively. These results indicate that the storage stability of HSRC residual oils is comparable to that of No. 6 Fuel Oil, and the nitrogen blanketing during storage is important in maintaining the specified viscosity characteristics of the residual oils. An almost identical change in the viscosity of TSL SRC residual oil with storage time in nitrogen and air atmospheres suggests that such oils are relatively more stable than No. 6 Fuel Oil and HSRC residual oil, and that the viscosity increase during storage is mainly due to the loss of volatile components rather than to any associated aging effect.

What is claimed is:

1. A homogeneous, single phase blend of fuel oil having long term viscosity stability consisting essentially of a blend of: (1) deashed solvent refined coal selected from the group consisting of a first-stage deashed 850° F.+ coal (SRC), a first-stage critical solvent deashed 850° F.+ coal (HSRC) and a two-stage liquefaction deashed 850° F.+ coal (TSL SRC) with (2) a distillate oil selected from the group consisting of a first-stage 400°–650° F. middle distillate oil, a first-stage 650°–850° F. heavy distillate oil, a first-stage 450°–850° F. coal liquefaction derived solvent, a second stage 400°–650° F. middle distillate oil, a second-stage 650°–850° F. heavy distillate oil, a second stage 450°–850° F. coal liquefaction process solvent and combinations thereof, wherein said selected solvent refined coal is present in said blend in a quantity of from 40 to 50 weight % based on the the weight of said blend and wherein said selected distillate oil or mixture thereof contains a heteroatom content of at least about ¼ of the heteroatom content of said selected solvent refined coal.

2. The fuel oil of claim 1 wherein said solvent-refined coal is blended with said distillate oils in pulverized or molten form.

3. A fuel oil according to claim 1 wherein first-stage deashed 850° F.+ coal (SRC) is blended with a mixture of first-stage distillate oil and second-stage distillage oil.

4. A fuel oil according to claim 1 wherein first-stage deashed 850° F.+ coal (SRC) is blended with first-stage distillate oil.

5. A fuel oil according to claim 1 consisting essentially of first-stage deashed coal (SRC), second-stage heavy oil and first-stage heavy oil in an amount equal to or greater than 10 wt%.

6. A fuel oil according to claim 1 consisting essentially of first-stage deashed 850° F.+ coal (SRC), second-stage middle oil and first-stage heavy oil in an amount greater than 15 wt%.

7. A fuel oil according to claim 1 consistng essentially of first-stage deashed 850° F. coal (SRC), second-stage process solvent and first-stage process solvent in an amount at least equal to 20 wt%.

8. A method for preparing a homogeneous, single-phase blend of fuel oil which comprises blending two components, (1) a deashed solvent refined coal selected from the group consisting of a first-stage deashed 850° F.+ coal, a first-stage critical solvent deashed 850° F.+ coal and a two-stage liquefaction deashed 850° F.+ coal with (2) a distillate oil selected from the group consisting of a first-stage 400°-650° F. middle distillate oil, a first-stage 650°-850° F. heavy distillate oil, a first-stage 450°-850° F. coal liquefaction process solvent, a second-stage 400°-650° F. middle distillate oil, a second-stage 650°-850° F. heavy distillate oil, a second-stage 450°-850° F. coal liquefaction process solvent and combinations thereof, to the extent that the selected solvent refined coal is present in said blend in quantity of from 40 to 50 weight % based on the weight of said blend and wherein said selected distillate oil or mixture thereof contains a heteroatom content of at least about one quarter of the heteroatom content of said selected solvent refined coal.

* * * * *